US011094271B2

(12) United States Patent
Huang

(10) Patent No.: US 11,094,271 B2
(45) Date of Patent: Aug. 17, 2021

(54) DRIVING CIRCUIT OF DISPLAY PANEL AND DISPLAY DEVICE

(71) Applicant: HKC Corporation Limited, Shenzhen (CN)

(72) Inventor: Xiaoyu Huang, Shenzhen (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/043,565

(22) PCT Filed: Nov. 27, 2018

(86) PCT No.: PCT/CN2018/117730
§ 371 (c)(1),
(2) Date: Sep. 29, 2020

(87) PCT Pub. No.: WO2020/097978
PCT Pub. Date: May 22, 2020

(65) Prior Publication Data

US 2021/0035510 A1 Feb. 4, 2021

(30) Foreign Application Priority Data

Nov. 12, 2018 (CN) ..... 201811338866.8

(51) Int. Cl.
*G09G 3/36* (2006.01)

(52) U.S. Cl.
CPC ..... *G09G 3/36* (2013.01); *G09G 3/3648* (2013.01); *G09G 3/3696* (2013.01);
(Continued)

(58) Field of Classification Search
CPC ..... G09G 3/36; G09G 3/3696; G09G 3/3648; G09G 2310/061; G09G 2310/0245;
(Continued)

(56) References Cited

U.S. PATENT DOCUMENTS 6,271,812 B1 * 8/2001 Osada ..... G09G 3/30 315/169.1
7,602,364 B2 * 10/2009 Shih ..... G09G 3/3648 345/211

(Continued)

FOREIGN PATENT DOCUMENTS

CN 101183504 A 5/2008
CN 103761953 A 4/2014

(Continued)

OTHER PUBLICATIONS

International Search Report dated Aug. 14, 2019, issued in corresponding International Application No. PCT/CN2018/117730, filed Nov. 27, 2018, 2 pages.

(Continued)

*Primary Examiner* — Michael J Jansen, II
(74) *Attorney, Agent, or Firm* — Christensen O'Connor Johnson K

(57) ABSTRACT

Disclosed is a driving circuit, comprising an energy storage circuit, a first circuit, a current limiting circuit, a first switching circuit, and a second switching circuit. A first preset voltage and a second preset voltage are input by means of the first circuit. The first circuit is electrically connected to the energy storage circuit. The current limiting circuit is electrically connected to a power supply. The first switching circuit is separately electrically connected to the first circuit and the current limiting circuit. The first switching circuit is electrically connected to output ends of a display panel and a driving chip. The second switching circuit is electrically connected to the first circuit and the current limiting circuit. An output end of the second switching circuit is electrically connected to the display panel. Also provided is a display device.

20 Claims, 3 Drawing Sheets

(52) U.S. Cl.
CPC ..... *G09G 2310/0245* (2013.01); *G09G 2310/0264* (2013.01); *G09G 2310/061* (2013.01); *G09G 2320/0257* (2013.01); *G09G 2330/021* (2013.01); *G09G 2330/027* (2013.01)

(58) Field of Classification Search
CPC ..... G09G 2310/0264; G09G 2330/027; G09G 2320/0257; G09G 2330/021
See application file for complete search history.

(56) References Cited

U.S. PATENT DOCUMENTS

| | | | | |
|---|---|---|---|---|
| 8,040,309 | B2 * | 10/2011 | Hung | G09G 3/3696 345/92 |
| 8,625,039 | B2 * | 1/2014 | Tajiri | G09G 3/3677 349/42 |
| 8,711,137 | B2 * | 4/2014 | Fang | G09G 3/3648 345/212 |
| 8,803,440 | B2 * | 8/2014 | Cao | G09G 3/3406 315/291 |
| 9,159,267 | B2 * | 10/2015 | Tajiri | G09G 3/3258 |
| 9,541,981 | B2 * | 1/2017 | Shirakami | G09G 3/3696 |
| 10,438,546 | B2 * | 10/2019 | Yang | G09G 3/20 |
| 10,510,316 | B2 * | 12/2019 | Xiong | G05F 1/565 |
| 10,629,129 | B2 * | 4/2020 | Xiao | G09G 3/3614 |
| 10,714,045 | B2 * | 7/2020 | Sun | G09G 3/3696 |
| 10,747,075 | B2 * | 8/2020 | Li | G02F 1/136204 |
| 10,885,864 | B2 * | 1/2021 | Huang | G09G 3/3266 |
| 2002/0196223 | A1 * | 12/2002 | Takahashi | G09G 3/367 345/90 |
| 2005/0099376 | A1 * | 5/2005 | Shih | G09G 3/3648 345/98 |
| 2007/0176866 | A1 * | 8/2007 | Hung | G09G 3/3696 345/87 |
| 2007/0182670 | A1 * | 8/2007 | Watanabe | G09G 3/22 345/75.2 |
| 2009/0097180 | A1 * | 4/2009 | Feng | H05B 41/2855 361/91.1 |
| 2010/0097365 | A1 * | 4/2010 | Fang | G09G 3/3696 345/212 |
| 2011/0075063 | A1 * | 3/2011 | Tajiri | G09G 3/3258 349/42 |
| 2013/0241416 | A1 * | 9/2013 | Toth | H05B 45/50 315/127 |
| 2013/0249876 | A1 | 9/2013 | Huang et al. | |
| 2014/0092074 | A1 * | 4/2014 | Tajiri | G09G 3/3677 345/211 |
| 2014/0176855 | A1 * | 6/2014 | Cao | H05B 45/37 349/61 |
| 2015/0309550 | A1 * | 10/2015 | Shirakami | G06F 1/30 713/300 |
| 2017/0206851 | A1 * | 7/2017 | Sun | G09G 3/2092 |
| 2017/0345372 | A1 * | 11/2017 | Xiao | G09G 3/3266 |
| 2018/0240414 | A1 * | 8/2018 | Yang | G09G 3/36 |
| 2019/0130865 | A1 * | 5/2019 | Xiong | G05F 1/62 |
| 2019/0221183 | A1 * | 7/2019 | Hou | H02M 3/155 |
| 2019/0235326 | A1 * | 8/2019 | Li | G09G 3/3648 |
| 2020/0135131 | A1 * | 4/2020 | Huang | G09G 3/3696 |
| 2020/0372871 | A1 * | 11/2020 | Chen | G09G 3/3648 |
| 2021/0027690 | A1 * | 1/2021 | Ji | G09G 3/20 |
| 2021/0035510 | A1 * | 2/2021 | Huang | G09G 3/36 |

FOREIGN PATENT DOCUMENTS

| | | | |
|---|---|---|---|
| CN | 106952628 | A | 7/2017 |
| JP | 3979498 | B2 | 9/2007 |
| KR | 20050097038 | A | 10/2005 |

OTHER PUBLICATIONS

Notice of Reason for Rejection dated Dec. 3, 2019, issued in Chinese Application No. 201811338866.8, filed Nov. 12, 2018, 9 pages.

* cited by examiner

DRIVING CIRCUIT OF DISPLAY PANEL AND DISPLAY DEVICE

CROSS REFERENCE TO RELATED APPLICATIONS

This application claims priority to Chinese Patent Application No. 201811338866.8, filed with the Chinese Patent Office on Nov. 12, 2018 and entitled "DRIVING CIRCUIT OF DISPLAY PANEL AND DISPLAY DEVICE", which is incorporated herein by reference in its entirety.

TECHNICAL FIELD

This application relates to the technical field of liquid crystal display, and more specifically, relates to a drive circuit for a display panel, and a display device.

BACKGROUND

The description herein provides only background information related to this application, but does not necessarily constitute the existing technology.

Thin film transistor liquid crystal display (TFT-LCD) is one of main varieties of present flat-panel displays and has become an important display platform for modern information technology (IT) and video products.

A main drive principle for a TFT-LCD is as follows: a system mainboard connects a red/green/blue (R/GB) compression signal (a tricolor signal), a control signal and power to a connector on a printed circuit board (PCB) through wires; data is processed by a timing controller (TC) integrated circuit (IC) on the PCB, passes through the PCB and is connected to a display region through a source-chip on film (S-COF) and a gate-chip on film (G-COF); and therefore, the LCD obtains required power and signals.

In recent years, gate on array (GOA) technologies have been rapidly developed to meet requirements on ultra-narrow frame and cost reduction.

During actual running, for solving the problems of power-off afterimage and the like, a G-COF in a conventional architecture is integrated with an output all on (XAO) function. That is, in an off state, gate turning-on signals are output by all output of the G-COF to turn on all TFTs in a display panel and neutralize charges in pixel electrodes to avoid power-off afterimage caused by residual charges after power-off. Since a G-COF is integrated into an array substrate, it is impossible for a GOA technology to solve the problem of power-off afterimage.

SUMMARY

In view of this, this application discloses a drive circuit for a display panel and a display device, to solve the problem of power-off afterimage in a GOA architecture, improve quality of a product and improve competitiveness of the product.

A drive circuit for a display panel includes:

an energy storage circuit;

a first circuit, wherein a first preset voltage is input through a first input end of the first circuit, a second preset voltage is input through a second input end of the first circuit and the second input end of the first circuit is electrically connected to the energy storage circuit;

a current limiting circuit, wherein an input end of the current limiting circuit is electrically connected to an output end of a power supply;

a first switching circuit, wherein a first input end of the first switching circuit is electrically connected to an output end of the first circuit and an output end of the current limiting circuit respectively, a second input end of the first switching circuit is electrically connected to an output end of a drive chip, and an output end of the first switching circuit is electrically connected to the display panel; and a second switching circuit, wherein a first input end of the second switching circuit is electrically connected to the output end of the first circuit and the output end of the current limiting circuit respectively, a third preset voltage is input through a second input end of the second switching circuit, and an output end of the second switching circuit is electrically connected to the display panel, and wherein:

the first circuit is configured to control the first switching circuit to be turned on or off, and the first circuit is further configured to control the second switching circuit to be turned on or off, so that when the first switching circuit is turned on, the second switching circuit is turned off, and when the second switching circuit is turned on, the first switching circuit is turned off.

In an embodiment, the energy storage circuit includes:

a capacitor, wherein one end of the capacitor is electrically connected to the second preset voltage and the second input end of the first circuit respectively and another end of the capacitor is grounded.

In an embodiment, the first circuit includes:

a comparator, wherein the first preset voltage is input through a first input end of the comparator, the second preset voltage is input through a second input end of the comparator, the second input end of the comparator is electrically connected to the energy storage circuit and an output end of the comparator is electrically connected to the first input end of the first switching circuit and the first input end of the second switching circuit respectively.

In an embodiment, the current limiting circuit includes:

a first resistor, wherein one end of the first resistor is electrically connected to the first input end of the first switching circuit and the first input end of the second switching circuit respectively, and another end of the first resistor is electrically connected to the output end of the power supply.

In an embodiment, the first switching circuit includes:

a first switching transistor, wherein a gate of the first switching transistor is electrically connected to the output end of the first circuit and the output end of the current limiting circuit respectively, a source of the first switching transistor is electrically connected to the output end of the drive chip, and a drain of the first switching transistor is electrically connected to the display panel; or the source of the first switching transistor is electrically connected to the display panel and the drain of the first switching transistor is electrically connected to the output end of the drive chip.

In an embodiment, the second switching circuit includes:

a second switching transistor, wherein a gate of the second switching transistor is electrically connected to the output end of the first circuit and the output end of the current limiting circuit respectively, the third preset voltage is input through a source of the second switching transistor, and a drain of the second switching transistor is electrically connected to the display panel; or the source of the second switching transistor is electrically connected to the display panel and the third preset voltage is input through the drain of the second switching transistor.

In an embodiment, the drive circuit further includes:

a step-down circuit, electrically connected between the third preset voltage and the second input end of the second switching circuit.

In an embodiment, the step-down circuit includes:

a second resistor, wherein one end of the second resistor is electrically connected to the third preset voltage and another end of the second resistor is electrically connected to the second input end of the second switching circuit.

A drive circuit for a display panel includes:

an energy storage circuit;

a comparator, wherein a first preset voltage is input through a first input end of the comparator, a second preset voltage is input through a second input end of the comparator and the second input end of the comparator is electrically connected to the energy storage circuit;

a current limiting circuit, wherein an input end of the current limiting circuit is electrically connected to an output end of a power supply;

a first switching transistor, wherein a first input end of the first switching transistor is electrically connected to an output end of the comparator and an output end of the current limiting circuit respectively, a second input end of the first switching transistor is electrically connected to an output end of a drive chip and an output end of the first switching transistor is electrically connected to the display panel; and a second switching transistor, wherein a first input end of the second switching transistor is electrically connected to the output end of the comparator and the output end of the current limiting circuit respectively, a third preset voltage is input through a second input end of the second switching transistor and an output end of the second switching transistor is electrically connected to the display panel, and wherein:

when the first switching transistor is turned on, the second switching transistor is turned off and, when the second switching transistor is turned on, the first switching transistor is turned off.

According to this application, the energy storage circuit, the first circuit, the current limiting circuit, the first switching circuit and the second switching circuit cooperate, and the first switching circuit and the second switching circuit are controlled through the first circuit to be turned on or off, so that the problem of power-off afterimage under a GOA architecture can be solved, quality of a product can be improved and competitiveness of the product can be further improved.

BRIEF DESCRIPTION OF THE DRAWINGS

To describe the technical solutions in the embodiments of this application or in the prior art more clearly, the following briefly introduces the accompanying drawings required for describing the embodiments or the prior art. Apparently, the accompanying drawings in the following description show merely the embodiments of this application, and a person of ordinary skill in the art may still derive other drawings from these accompanying drawings without creative efforts.

LIST OF REFERENCE NUMERALS

Figure 1:
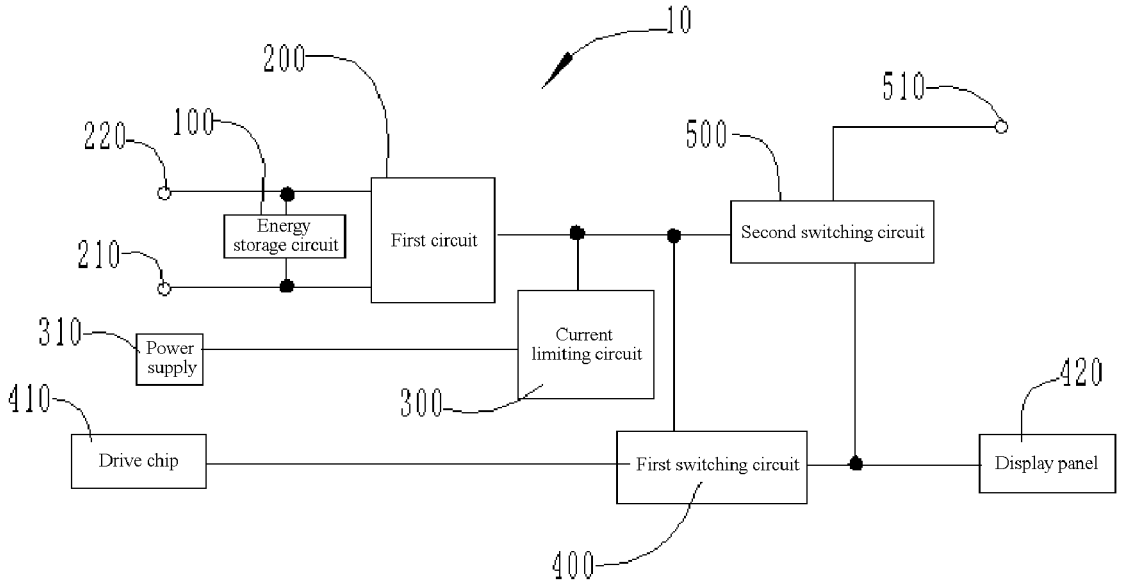
FIG. 1 is a structure block diagram of a drive circuit according to an embodiment of this application.

10 Drive circuit
100 Energy storage circuit
110 Capacitor
20 Display device
200 First circuit
210 First preset voltage
220 Second preset voltage
230 Comparator
300 Current limiting circuit
310 Power supply
320 First resistor
400 First switching circuit
410 Drive chip
420 Display panel
430 First switching transistor
431 First field effect transistor
500 Second switching circuit
510 Third preset voltage
520 Second switching transistor
521 Second field effect transistor
530 Step-down circuit
531 Second resistor

DETAILED DESCRIPTION OF THE EMBODIMENTS

The following clearly and completely describes the technical solutions in the embodiments of this application with reference to the accompanying drawings in the embodiments of this application. Apparently, the described embodiments are some embodiments of this application rather than all of the embodiments. All other embodiments obtained by a person of ordinary skill in the art based on the embodiments of this application without creative efforts shall fall within the protection scope of this application.

Embodiments of this application disclose a drive circuit for a display panel and a display device, to solve the problem of power-off afterimage in a GOA architecture, improve quality of a product and improve competitiveness of the product.

Referring to FIG. 1, an embodiment of this application provides a drive circuit, which includes an energy storage circuit 100, a first circuit 200, a current limiting circuit 300, a first switching circuit 400 and a second switching circuit 500. A first preset voltage 210 is input through a first input end of the first circuit 200. A second preset voltage 220 is input through a second input end of the first circuit 200 and the second input end of the first circuit 200 is electrically connected to the energy storage circuit 100. An input end of the current limiting circuit 300 is electrically connected to an output end of a power supply 310.

A first input end of the first switching circuit 400 is electrically connected to an output end of the first circuit 200 and an output end of the current limiting circuit 300 respectively. A second input end of the first switching circuit 400 is electrically connected to an output end of a drive chip 410. An output end of the first switching circuit 400 is electrically connected to the display panel 420. A first input end of the second switching circuit 500 is electrically connected to the output end of the first circuit 200 and the output end of the current limiting circuit 300 respectively. A third preset voltage 510 is input through a second input end of the second switching circuit 500. An output end of the second switching circuit 500 is electrically connected to the display panel 420.

The first circuit 200 is configured to control the first switching circuit 400 to be turned on or off. The first circuit 200 is further configured to control the second switching circuit 500 to be turned on or off. When the first switching circuit 400 is turned on, the second switching circuit 500 is turned off. When the second switching circuit 500 is turned on, the first switching circuit 400 is turned off.

It can be understood that a specific configuration of the energy storage circuit 100 is not specifically limited as long as energy storage may be ensured. In an embodiment, the energy storage circuit 100 may formed by a first capacitor. In an embodiment, the energy storage circuit 100 may formed by a storage battery. The specific configuration of the energy storage circuit 100 may be selected according to an actual requirement.

The first preset voltage 210 is input through the first input end of the first circuit 200. The first preset voltage 210 refers to an input voltage of the display panel 420. It can be understood that a specific numerical value of the first preset voltage 210 is not limited as long as the first preset voltage 210 is constant. In an embodiment, the first preset voltage 210 may be a direct current voltage of 12 V. In an embodiment, the first preset voltage 210 may be a direct current voltage of 14 V. The specific numerical value of the first preset voltage 210 may be selected according to an actual requirement. The second preset voltage 220 is input through the second input end of the first circuit 200. The second preset voltage 220 refers to a stabilized input voltage. Similarly, a specific numerical value of the second preset voltage 220 is also not specifically limited. In an embodiment, the second preset voltage 220 may be set to be 12 V or 14 V.

It can be understood that a specific configuration of the first circuit 200 may not be specifically limited as long as the first switching circuit 400 and the second switching circuit 500 may be controlled to be turned on and turned off based on the first preset voltage 210 and the second voltage 220. In an embodiment, the first circuit 200 may be formed by an operational amplifier. The operational amplifier outputs a control signal, thereby controlling the first switching circuit 400 and the second switching circuit 500 to be turned on and turned off. In an embodiment, the first circuit 200 may also be formed by a first comparator. Specifically, when the first comparator outputs a high level, the first switching circuit 400 is turned off and the second switching circuit 500 is turned on. When the first comparator outputs a low level, the first switching circuit 400 is turned on and the second switching circuit 500 is turned off.

It can be understood that a specific configuration of the current limiting circuit 300 may not be specifically limited as long as safety of the drive circuit 10 is ensured. In an embodiment, the current limiting circuit 300 may be formed by a resistor with fixed resistance. In an embodiment, the current limiting circuit 300 may be formed by a sliding rheostat. The specific configuration may be selected according to an actual requirement.

The first switching circuit 400 receives a control signal of the first circuit 200. When the control signal is a low level, the first switching circuit 400 is in an on state. When the control signal is a high level, the first switching circuit 400 is in an off state. A specific configuration of the first switching circuit 400 may not be specifically limited as long as a function of switching according to the control signal output by the first circuit 200 may be ensured. In an embodiment, the first switching circuit 400 is a relay control switch. In an embodiment, the first switching circuit 400 is a switching transistor control switch.

The second switching circuit 500 receives the control signal of the first circuit 200. When the control signal is a high level, the second switching circuit 500 is in the off state. When the control signal is a low level, the second switching circuit 500 is in the on state. A specific configuration of the second switching circuit 500 may not be specifically limited as long as the function of switching according to the control signal output by the first circuit 200 may be ensured. In an embodiment, the second switching circuit 500 is a relay control switch. In an embodiment, the second switching circuit 500 is a switching transistor control switch.

In the embodiment, the energy storage circuit 100, the first circuit 200, the current limiting circuit 300, the first switching circuit 400 and the second switching circuit 500 cooperate, and the first switching circuit 400 and the second switching circuit 500 are controlled through the first circuit 200 to be turned on and turned off, so that the problem of power-off afterimage under a GOA architecture can be solved, quality of a product can be improved and competitiveness of the product can be further improved.

Figure 2:
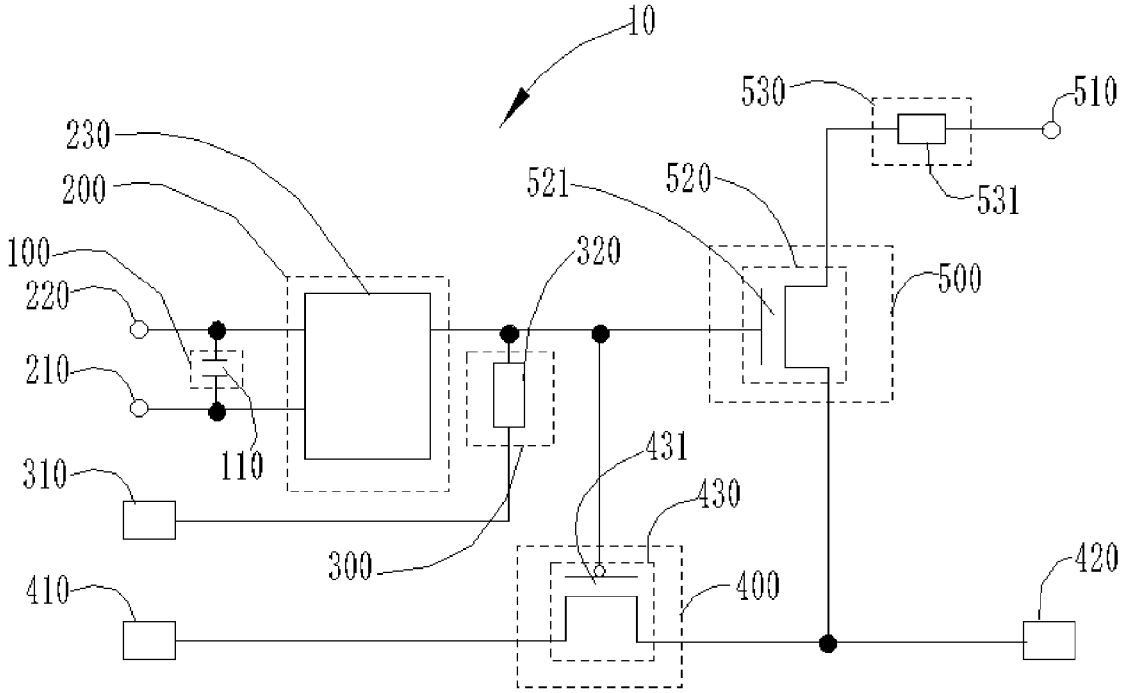
FIG. 2 is a circuit schematic diagram of a drive circuit according to an embodiment of this application.

Referring to FIG. 2, in an embodiment, the energy storage circuit 100 includes a capacitor 110. One end of the capacitor 110 is electrically connected to the second preset voltage 220 and the second input end of the first circuit 200 respectively, and another end of the capacitor 110 is grounded. When a system is powered off (that is, the drive circuit 10 is turned off), under a voltage stabilization effect of the capacitor 110 (that is, stored electric energy is released), the second preset voltage 220 is temporally kept at an original voltage and the first circuit 200 further outputs a high level.

In an embodiment, the first circuit 200 includes a comparator 230. The first preset voltage 210 is input through a first input end of the comparator 230. The second preset voltage 220 is input through a second input end of the comparator 230 and the second input end of the comparator 230 is electrically connected to the energy storage circuit 100. An output end of the comparator 230 is electrically connected to the first input end of the first switching circuit 400 and the first input end of the second switching circuit 500 respectively.

In an embodiment, when the comparator 230 outputs a high level, the first switching circuit 400 is turned off and the second switching circuit 500 is turned on. In an embodiment, when the comparator 230 outputs a low level, the first switching circuit 400 is turned on and the second switching circuit 500 is turned off. In an embodiment, the comparator 230 may also be replaced with an operational amplifier or the like.

In an embodiment, the current limiting circuit 300 includes a first resistor 320. One end of the first resistor 320 is electrically connected to the first input end of the first switching circuit 400 and the first input end of the second switching circuit 500 respectively, and another end of the first resistor 320 is electrically connected to the output end of the power supply 310. It can be understood that a specific configuration of the first resistor 320 may not be specifically limited as long as a current limiting function may be realized. In an embodiment, the first resistor 320 is a sliding rheostat with variable resistance. In an embodiment, the first resistor 320 is a resistor with fixed resistance.

In an embodiment, the first switching circuit 400 includes a first switching transistor 430. A gate of the first switching transistor 430 is electrically connected to the output end of the first circuit 200 and the output end of the current limiting circuit 300. A source of the first switching transistor 430 is electrically connected to the output end of the drive chip 410 and a drain of the first switching transistor 430 is electrically connected to the display panel 420. Alternatively, the source of the first switching transistor 430 is electrically connected to the display panel 420 and the drain of the first switching transistor 430 is electrically connected to the output end of the drive chip 410.

It can be understood that, when the source of the first switching transistor 430 is electrically connected to the output end of the drive chip 410, the drain of the first switching transistor 430 is electrically connected to the display panel 420. When the drain of the first switching transistor 330 is electrically connected to the output end of the drive chip 410, the source of the first switching transistor 430 is electrically connected to the display panel 420. That is, the drain and source of the first switching transistor 430 may be selected according to an actual requirement and a position relationship therebetween is not specifically limited. The first switching transistor 430 may adopt a first metal oxide silicon (MOS) transistor (field effect transistor) 431. In an embodiment, the first switching transistor 430 may adopt an N-channel MOS transistor. In an embodiment, the first switching transistor 430 may also adopt a P-channel MOS transistor. A specific configuration may be selected according to an actual requirement.

In an embodiment, the second switching circuit 500 includes a second switching transistor 520. A gate of the second switching transistor 520 is electrically connected to the output end of the first circuit 200 and the output end of the current limiting circuit 300 respectively. The third preset voltage 510 is input through a source of the second switching transistor 410 and a drain of the second switching transistor 520 is electrically connected to the display panel 420. Alternatively, the source of the second switching transistor 520 is electrically connected to the display panel 420 and the third preset voltage 510 is input through the drain of the second switching transistor 520.

It can be understood that, when the source of the second switching transistor 520 is electrically connected to the first input end of the first circuit 200, the drain of the second switching transistor 520 is electrically connected to the display panel 420. When the drain of the second switching transistor 520 is electrically connected to the first input end of the first circuit 200, the source of the second switching transistor 520 is electrically connected to the display panel 420. That is, the drain and source of the second switching transistor 520 may be selected according to an actual requirement and a position relationship therebetween is not specifically limited.

In an embodiment, the second switching transistor 520 may adopt a second MOS transistor (field effect transistor) 521. In an embodiment, the second switching transistor 520 may adopt an N-channel MOS transistor. In an embodiment, the second switching transistor 520 may also adopt a P-channel MOS transistor. A specific configuration may be selected according to an actual requirement. In an embodiment, the second switching transistor 520 adopts a P-channel MOS transistor and the first switching transistor 430 adopts an N-channel MOS transistor. In an embodiment, the second switching transistor 520 adopts an N-channel MOS transistor and the first switching transistor 430 adopts a P-channel MOS transistor.

It can be understood that a specific numerical value of the third preset voltage 510 is not limited as long as all TFTs in the display panel 420 are turned on. In an embodiment, the numerical value of the third preset voltage 510 may be 28 V. In an embodiment, the numerical value of the third preset voltage 510 may be 33 V. The specific numerical value of the third preset voltage 510 may be selected according to an actual requirement.

In an embodiment, the drive circuit 10 further includes a step-down circuit 530, electrically connected between the third preset voltage 510 and the second input end of the second switching circuit 400. It can be understood that a specific configuration of the step-down circuit 530 may not be specifically limited as long as the safety of the drive circuit 10 is ensured. In an embodiment, the step-down circuit 530 may be formed by a resistor with fixed resistance. In an embodiment, the step-down circuit 530 may be formed by a sliding rheostat with variable resistance. A specific configuration of the step-down circuit 530 may be selected according to an actual requirement.

In an embodiment, the step-down circuit 530 includes a second resistor 531. One end of the second resistor 531 is electrically connected to the third preset voltage 510. Another end of the second resistor 531 is electrically connected to the second input end of the second switching circuit 400. It can be understood that a specific configuration of the second resistor 531 may not be specifically limited as long as the current limiting function may be realized. In an embodiment, the second resistor 531 is a sliding rheostat with variable resistance. In an embodiment, the second resistor 531 is a resistor with fixed resistance.

Figure 3:
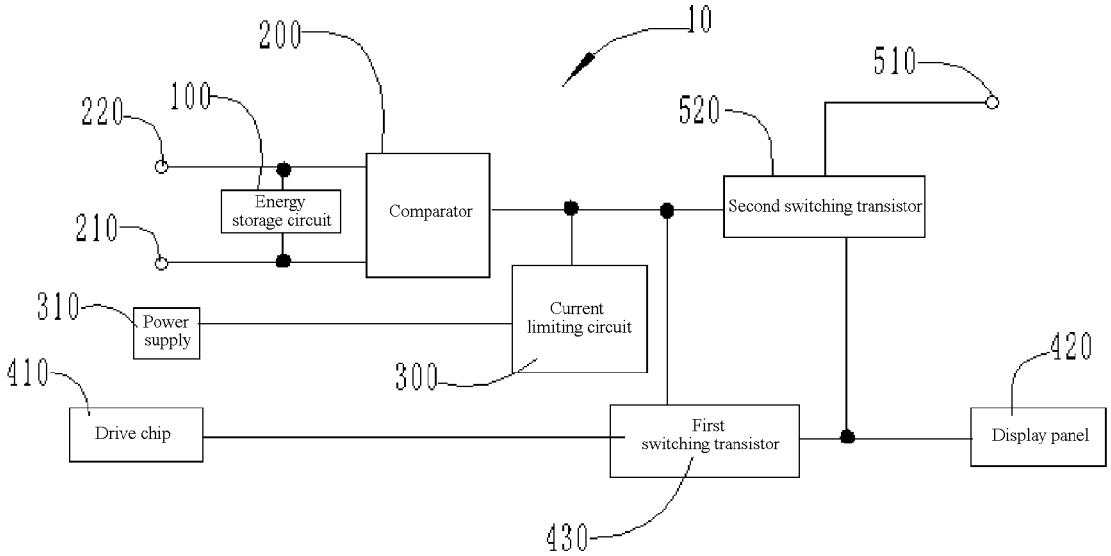
FIG. 3 is a structure block diagram of a drive circuit according to another embodiment of this application.

Referring to FIG. 3, an embodiment of this application provides a drive circuit for a display panel, which includes an energy storage circuit 100, a comparator 230, a current limiting circuit 300, a first switching transistor 430 and a second switching transistor 520. A first preset voltage 210 is input through a first input end of the comparator 230. A second preset voltage 220 is input through a second input end of the comparator 230 and the second input end of the comparator 230 is electrically connected to the energy storage circuit 100. An input end of the current limiting circuit 300 is electrically connected to an output end of a power supply 310.

A first input end of the first switching transistor 430 is electrically connected to an output end of the comparator 230 and an output end of the current limiting circuit 300 respectively. A second input end of the first switching transistor 430 is electrically connected to an output end of a drive chip 410. An output end of the first switching transistor 430 is electrically connected to the display panel 420. A first input end of the second switching transistor 520 is electrically connected to the output end of the comparator 230 and the output end of the current limiting circuit 300 respectively. A third preset voltage 510 is input through a second input end of the second switching transistor 520. An output end of the second switching transistor 520 is electrically connected to the display panel 420. When the first switching transistor 430 is turned on, the second switching transistor 520 is turned off, and when the second switching transistor 520 is turned on, the first switching transistor 430 is turned off.

It can be understood that a specific configuration of the energy storage circuit 100 is not specifically limited as long as energy storage may be ensured. In an embodiment, the energy storage circuit 100 may be formed by a first capacitor. In an embodiment, the energy storage circuit 100 may be formed by a storage battery. The specific configuration of the energy storage circuit 100 may be selected according to an actual requirement.

The first preset voltage 210 refers to an input voltage of the display panel 420. It can be understood that a specific numerical value of the first preset voltage 210 is not limited as long as the first preset voltage 210 is constant. In an embodiment, the first preset voltage 210 may be a direct current voltage of 12 V. In an embodiment, the first preset voltage 210 may be a direct current voltage of 14 V. The specific numerical value of the first preset voltage 210 may be selected according to an actual requirement. The second preset voltage 220 refers to a stabilized input voltage. Similarly, a specific numerical value of the second preset voltage 220 is also not specifically limited. In an embodiment, the second preset voltage 220 may be set to be 12 V or 14 V.

In an embodiment, when the comparator 230 outputs a high level, the first switching transistor 430 is turned off and the second switching transistor 520 is turned on. In an embodiment, when the comparator 230 outputs a low level, the first switching transistor 430 is turned on and the second switching transistor 520 is turned off. In an embodiment, the comparator 230 may also be replaced with an operational amplifier and the like.

It can be understood that a specific configuration of the current limiting circuit 300 may not be specifically limited as long as safety of the drive circuit 10 is ensured. In an embodiment, the current limiting circuit 300 may be formed by a resistor with fixed resistance. In an embodiment, the current limiting circuit 300 may be formed by a sliding rheostat. The specific configuration may be selected according to an actual requirement.

The first switching transistor 430 receives a control signal of the comparator 230. When the control signal is a low level, the first switching transistor 430 is in an on state. When the control signal is a high level, the first switching transistor 430 is in an off state. A specific configuration of the first switching transistor 430 may not be specifically limited as long as a function of switching according to the control signal output by the comparator 230 may be ensured. In an embodiment, the first switching transistor 430 may be a relay control switch. In an embodiment, the first switching transistor 430 may be an MOS transistor switch.

The second switching transistor 520 receives the control signal of the comparator 230. When the control signal is a high level, the second switching transistor 520 is in the off state. When the control signal is a low level, the second switching transistor 520 is in the on state. A specific configuration of the second switching transistor 520 may not be specifically limited as long as the function of switching according to the control signal output by the comparator 230 may be ensured. In an embodiment, the second switching transistor 520 is a relay control switch. In an embodiment, the second switching transistor 520 is a switching transistor control switch.

In the embodiment, the energy storage circuit 100, the comparator 230, the current limiting circuit 300, the first switching transistor 430 and the second switching transistor 520 cooperate, and the first switching transistor 430 and the second switching transistor 520 are controlled through the comparator 230 to be turned on and turned off, so that the problem of power-off afterimage under a GOA architecture can be solved, quality of a product can be improved and competitiveness of the product can be further improved.

A working process of this application is as follows.

The second switching circuit 500 adopts an N-channel MOS transistor. When a control signal received by a gate of the N-channel MOS transistor is a high level, the N-channel MOS transistor is turned on. When the control signal received by the gate of the N-channel MOS transistor is a low level, the N-channel MOS transistor is turned off. The first switching circuit 400 adopts a P-channel MOS transistor. When a control signal received by a gate of the P-channel MOS transistor is a low level, the P-channel MOS transistor is turned on. When the control signal received by the gate of the P-channel MOS transistor is a high level, the P-channel MOS transistor is turned off. The first circuit 200 may adopt the comparator 230. When a positive voltage (i.e., the second preset voltage 220) of the comparator 230 is less than or equal to a negative voltage (i.e., the first preset voltage 210), the comparator 230 outputs a low level. When the positive voltage (i.e., the second preset voltage 220) of the comparator 230 is higher than the negative voltage (i.e., the first preset voltage 210), the comparator 230 outputs a high level. The capacitor 110 adopted for the energy storage circuit 100 is a voltage stabilization capacitor.

During normal work, the negative voltage of the comparator 230 is a constant direct current voltage (i.e., the first preset voltage 210, which is generally 12 V). In this case, the positive voltage (i.e., the second preset voltage 220) of the comparator 230 is equal to the negative voltage (i.e., the first preset voltage 210), that is, the comparator 230 outputs a low level. The control signals received by the gates of the N-channel MOS transistor and the P-channel MOS transistor are both low levels. In this case, the P-channel MOS transistor is turned on and the N-channel MOS transistor is turned off. In this case, an output voltage of the drive chip 410 is equal to an input voltage of the display panel 420.

When the system is powered off, an external input voltage (i.e., the first preset voltage 210) drops. Under the voltage stabilization effect of the capacitor 110 (that is, the releasing of the stored electric energy), the second preset voltage 220 is temporally kept at the original voltage (that is, the positive voltage of the comparator 230 is higher than the negative voltage). In this case, the comparator 230 outputs a high level. That is, the control signals received by the gates of the N-channel MOS transistor and the P-channel MOS transistor are both high levels. In this case, the P-channel MOS transistor is turned off and the N-channel MOS transistor is turned on. In this case, the input voltage of the display panel 420 is equal to the third preset voltage 510. That is, all the TFTs in the display panel 420 are turned on to neutralize charges in pixel electrodes to avoid power-off afterimage caused by residual charges after power-off.

From the above, in this application, the energy storage circuit 100, the first circuit 200, the current limiting circuit 300, the first switching circuit 400 and the second switching circuit 500 cooperate, and the first switching circuit 400 and the second switching circuit 500 are controlled through the first circuit 200 to be turned on and turned off, so that the problem of power-off afterimage under a GOA architecture can be solved, quality of a product can be improved and competitiveness of the product can be further improved.

Figure 4:
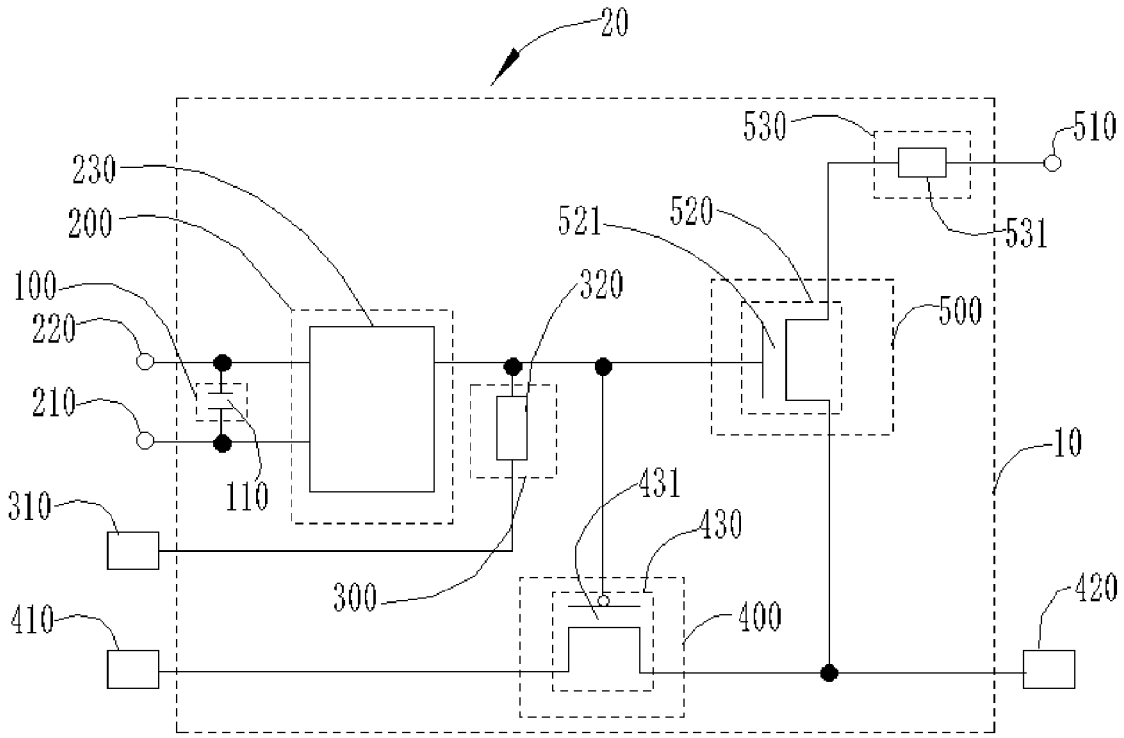
FIG. 4 is a structure block diagram of a display according to an embodiment of this application.

Referring to FIG. 4, an embodiment of this application also provides a display device 20, which includes a display panel 420 and the drive circuit 10 according to any foregoing embodiment.

Finally, it should be noted that the relational terms herein such as first and second are used only to differentiate an entity or operation from another entity or operation, and do not require or imply any actual relationship or sequence between these entities or operations. Moreover, the terms "include", "include", and any variants thereof are intended to cover a non-exclusive inclusion. Therefore, in the context of a process, method, object, or device that includes a series of elements, the process, method, object, or device not only includes such elements, but also includes other elements not specified expressly, or may include inherent elements of the process, method, object, or device. Without further limitation, the element defined by a phrase "include one . . . " does not exclude other same elements in the process, method, article or device which include the element.

It should be noted that the embodiments in this specification are all described in a progressive manner. Description of each of the embodiments focuses on differences from other embodiments, and reference may be made to each other for the same or similar parts among respective embodiments.

The above description of the disclosed embodiments enables persons skilled in the art to implement or use this application. Various modifications to these embodiments are obvious to persons skilled in the art, the general principles defined herein may be implemented in other embodiments without departing from the spirit and scope of this application. Therefore, this application is not limited to these embodiments illustrated herein, but needs to conform to the broadest scope consistent with the principles and novel features disclosed herein.

What is claimed is:

1. A drive circuit for a display panel, comprising:

an energy storage circuit;

a first circuit, wherein a first preset voltage is input through a first input end of the first circuit, a second preset voltage is input through a second input end of the first circuit and the second input end of the first circuit is electrically connected to the energy storage circuit;

a current limiting circuit, wherein an input end of the current limiting circuit is electrically connected to an output end of a power supply;

a first switching circuit, wherein a first input end of the first switching circuit is electrically connected to an output end of the first circuit and an output end of the current limiting circuit respectively, a second input end of the first switching circuit is electrically connected to an output end of a drive chip, and an output end of the first switching circuit is electrically connected to the display panel; and a second switching circuit, wherein a first input end of the second switching circuit is electrically connected to the output end of the first circuit and the output end of the current limiting circuit respectively, a third preset voltage is input through a second input end of the second switching circuit, and an output end of the second switching circuit is electrically connected to the display panel, and wherein:

the first circuit is configured to control the first switching circuit to be turned on or off, and the first circuit is further configured to control the second switching circuit to be turned on or off, so that when the first switching circuit is turned on, the second switching circuit is turned off, and when the second switching circuit is turned on, the first switching circuit is turned off.

2. The drive circuit according to claim 1, wherein the energy storage circuit comprises:

a capacitor, wherein one end of the capacitor is electrically connected to the second preset voltage and the second input end of the first circuit respectively, and another end of the capacitor is grounded.

3. The drive circuit according to claim 1, wherein the first circuit comprises:

a comparator, wherein the first preset voltage is input through a first input end of the comparator, the second preset voltage is input through a second input end of the comparator, the second input end of the comparator is electrically connected to the energy storage circuit and an output end of the comparator is electrically connected to the first input end of the first switching circuit and the first input end of the second switching circuit respectively.

4. The drive circuit according to claim 1, wherein the current limiting circuit comprises:

a first resistor, wherein one end of the first resistor is electrically connected to the first input end of the first switching circuit and the first input end of the second switching circuit respectively, and another end of the first resistor is electrically connected to the output end of the power supply.

5. The drive circuit according to claim 1, wherein the first switching circuit comprises:

a first switching transistor, wherein a gate of the first switching transistor is electrically connected to the output end of the first circuit and the output end of the current limiting circuit respectively, a source of the first switching transistor is electrically connected to the output end of the drive chip, and a drain of the first switching transistor is electrically connected to the display panel.

6. The drive circuit according to claim 5, wherein the first switching transistor is a first field effect transistor.

7. The drive circuit according to claim 1, wherein the first switching circuit comprises:

a first switching transistor, wherein a gate of the first switching transistor is electrically connected to the output end of the first circuit and the output end of the current limiting circuit respectively, a source of the first switching transistor is electrically connected to the display panel, and a drain of the first switching transistor is electrically connected to the output end of the drive chip.

8. The drive circuit according to claim 7, wherein the first switching transistor is a first field effect transistor.

9. The drive circuit according to claim 1, wherein the second switching circuit comprises:

a second switching transistor, wherein a gate of the second switching transistor is electrically connected to the output end of the first circuit and the output end of the current limiting circuit respectively, the third preset voltage is input through a source of the second switching transistor, and a drain of the second switching transistor is electrically connected to the display panel.

10. The drive circuit according to claim 8, wherein the second switching transistor is a second field effect transistor.

11. The drive circuit according to claim 1, wherein the second switching circuit comprises:

a second switching transistor, wherein a gate of the second switching transistor is electrically connected to the output end of the first circuit and the output end of the current limiting circuit respectively, a source of the second switching transistor is electrically connected to the display panel, and the third preset voltage is input through a drain of the second switching transistor.

12. The drive circuit according to claim 11, wherein the second switching transistor is a second field effect transistor.

13. The drive circuit according to claim 1, further comprising:

a step-down circuit, electrically connected between the third preset voltage and the second input end of the second switching circuit.

14. The drive circuit according to claim 13, wherein the step-down circuit comprises:

a second resistor, wherein one end of the second resistor is electrically connected to the third preset voltage, and another end of the second resistor is electrically connected to the second input end of the second switching circuit.

15. A drive circuit for a display panel, comprising:

an energy storage circuit;

a comparator, wherein a first preset voltage is input through a first input end of the comparator, a second preset voltage is input through a second input end of the comparator, and the second input end of the comparator is electrically connected to the energy storage circuit;

a current limiting circuit, wherein an input end of the current limiting circuit is electrically connected to an output end of a power supply;

a first switching transistor, wherein a first input end of the first switching transistor is electrically connected to an output end of the comparator and an output end of the current limiting circuit respectively, a second input end of the first switching transistor is electrically connected to an output end of a drive chip, and an output end of the first switching transistor is electrically connected to the display panel; and a second switching transistor, wherein a first input end of the second switching transistor is electrically connected to the output end of the comparator and the output end of the current limiting circuit respectively, a third preset voltage is input through a second input end of the second switching transistor, and an output end of the second switching transistor is electrically connected to the display panel, and wherein:

when the first switching transistor is turned on, the second switching transistor is turned off, and when the second switching transistor is turned on, the first switching transistor is turned off.

16. The drive circuit according to claim 15, wherein the energy storage circuit comprises:

a capacitor, wherein one end of the capacitor is electrically connected to the second preset voltage and the second input end of the first circuit respectively, and another end of the capacitor is grounded.

17. The drive circuit according to claim 16, wherein the current limiting circuit comprises:

a first resistor, wherein one end of the first resistor is electrically connected to the first input end of the first switching transistor and the first input end of the second switching transistor respectively, and another end of the first resistor is electrically connected to the output end of the power supply.

18. The drive circuit according to claim 1 claim 15 further comprising:

a step-down circuit, electrically connected between the third preset voltage and the second input end of the second switching transistor.

19. The drive circuit according to claim 18, wherein the step-down circuit comprises:

a second resistor, wherein one end of the second resistor is electrically connected to the third preset voltage, and another end of the second resistor is electrically connected to the second input end of the second switching transistor.

20. A display device, comprising a display panel and a drive circuit, wherein the drive circuit comprises:

an energy storage circuit;

a first circuit, wherein a first preset voltage is input through a first input end of the first circuit, a second preset voltage is input through a second input end of the first circuit, and the second input end of the first circuit is electrically connected to the energy storage circuit;

a current limiting circuit, wherein an input end of the current limiting circuit is electrically connected to an output end of a power supply;

a first switching circuit, wherein a first input end of the first switching circuit is electrically connected to an output end of the first circuit and an output end of the current limiting circuit respectively, a second input end of the first switching circuit is electrically connected to an output end of a drive chip, and an output end of the first switching circuit is electrically connected to the display panel; and a second switching circuit, wherein a first input end of the second switching circuit is electrically connected to the output end of the first circuit and the output end of the current limiting circuit respectively, a third preset voltage is input through a second input end of the second switching circuit, and an output end of the second switching circuit is electrically connected to the display panel, and wherein:

the first circuit is configured to control the first switching circuit to be turned on or off, and the first circuit is further configured to control the second switching circuit to be turned on or off, so that when the first switching circuit is turned on, the second switching circuit is turned off, and when the second switching circuit is turned on, the first switching circuit is turned off.

* * * * *